United States Patent [19]

Dolinsky

[11] 4,288,883

[45] Sep. 15, 1981

[54] COMBINED TOOTH BRUSH AND GUM MASSAGING

[76] Inventor: Josef Dolinsky, Salzstr. 4, 8960 Kempten, Fed. Rep. of Germany

[21] Appl. No.: 78,390

[22] Filed: Sep. 24, 1979

[30] Foreign Application Priority Data

Oct. 31, 1978 [DE] Fed. Rep. of Germany ..... 2847261

[51] Int. Cl.[3] ..... A46B 9/04; A61H 13/00

[52] U.S. Cl. ..... 15/110; 15/159 A; 15/167 R

[58] Field of Search ..... 15/167 R, 159 A, 110

[56] References Cited

U.S. PATENT DOCUMENTS

| | | | |
|---|---|---|---|
| 1,251,250 | 12/1917 | Libby | 15/110 |
| 1,924,152 | 8/1933 | Coney et al. | 15/167 R |
| 2,139,245 | 12/1938 | Ogden | 15/110 |
| 3,553,759 | 1/1971 | Kramer et al. | 15/110 |

FOREIGN PATENT DOCUMENTS

| | | | |
|---|---|---|---|
| 188848 | 2/1957 | Fed. Rep. of Germany | 15/167 R |
| 1075171 | 4/1954 | France | 15/167 R |
| 592300 | 4/1959 | Italy | 15/167 R |

*Primary Examiner*—Chris K. Moore
*Attorney, Agent, or Firm*—Haseltine & Lake

[57] ABSTRACT

A combined tooth brush and gum massaging device comprising a bristle head which includes an intermediate bristle portion and at both sides adjoining massaging portions, whereby the width of the bristle head is enlarged up to a value that the bristle portion can overlap teeth of the upper tooth row and teeth of the lower tooth row simultaneously when both tooth rows are in contact with one another. Therefore both tooth rows and adjoining gums can be treated simultaneously.

5 Claims, 6 Drawing Figures

FIG 1
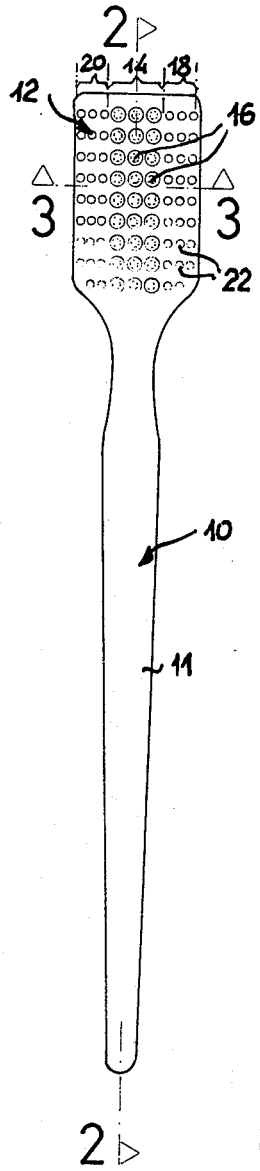
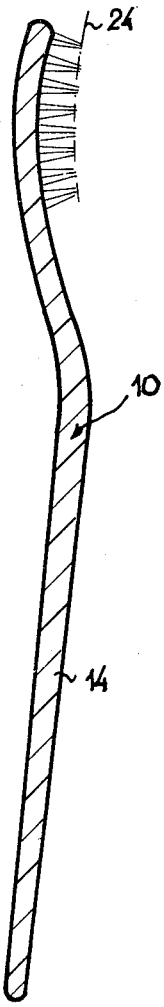
FIG 2
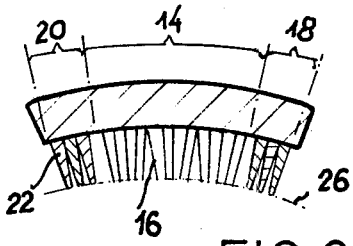
FIG 3
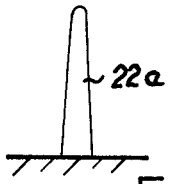
FIG 4
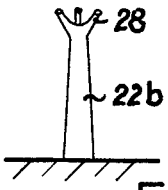
FIG 5
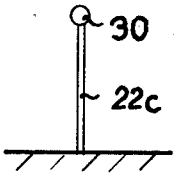
FIG 6

COMBINED TOOTH BRUSH AND GUM MASSAGING

The present invention is directed to a combined tooth brush and gum massaging device.

One object of the invention is to provide a tooth brush having conventional bristles for brushing in the normal manner with the addition of elastic massaging elements for massaging the gingival tips of the gums and cleaning between the teeth.

A further object is to provide a new tooth brush for improving the cleaning effect of the teeth and reducing the necessary period of time for the cleaning process.

A still further object is to provide for a perfect cleaning operation positively avoiding injuries of those more vulnerable parts of the teeth which have become accessible by retraction of the gums and injuries of the gums theirselves because of the scraping effect of the hard bristles.

A still further object is to provide a tooth brush the bristle head of which having an enlarged width of substantially twice the width of ordinary tooth brushes, in order to simultaneously treat both tooth rows and gums of the user.

These objects and further features will appear form the following description, reference being had to the accompanying drawing, in which FIG. 1 is a plan view of a new tooth brush, FIG. 2 is a longitudinal section along the line 2—2 of FIG. 1, FIG. 3 is a cross-section of the bristle head along line 3—3 of FIG. 1 on a larger scale and FIGS. 4 to 6 are views of alternative embodiments of massaging elements.

A tooth brush 10 is provided with an ordinary handle 11 and a bristle head 12 having a new shape. The bristle head 12 is substantially twice as broad as ordinary bristle heads and therefore enables the user to clean the upper and the lower tooth rows simultaneously.

The bristle head 12 is provided with a broad bristle retaining portion 14 in the middle region and a pair of lateral portions 18, 20 each of which oppositely adjoining to the bristle retaining portion 14. In the shown embodiment the portions 14 and 18, 20 are of the same length and extend over the length of the bristle head 12.

A plurality of relatively stiff bristles 16 are attached to the bristle retaining portion 14. Each of the lateral portions 18, 20 carries one or more rows of massaging elements 22 in the form of pins of rubber or suitable rubber substitute.

The actual dimensions and proportions of the three portions 14, 18, 20 are better shown in FIG. 3 instead of FIG. 1 because the latter serves only as a general plan view. From FIG. 3 it is evident that the width of the bristle retaining portion 14 is larger than the sum of said pair of lateral portions 18, 20. In the practical embodiment as shown in FIG. 3 the width of each lateral portion 18, 20. respectively lies in the region of 20 percent up to substantially 40 percent of the width of the intermediate bristle retaining portion 14. The new bristle head 12 has no longer a strip-like shape that means a much longer longitudinal extension with respect to the lateral dimension but rather is shaped almost as a square. In a preferred embodiment the bristle head has a length of 30 mm and a width of 22 mm. That means that the proportion of the lateral dimension to the longitudinal dimension of the bristle head is at least 2:3. Then the width of the bristle retaining portion is in the region of 12 mm to 14 mm and the width of each of the pair of lateral portions 18, 20 is in the region of 5.5 mm to 4 mm.

Tooth brushes of this kind are manufactured in different sizes, so that the suitable size can be chosen for each person. It should be clear that for children bristle the retaining portion must have a smaller width as compared with bristle heads for adults. Therefore the proportion of the width of the lateral portion with respect to the width of the bristle retaining portion is greater in a tooth brush for children—perhaps 40%—than it is the case in tooth brushes for adults—perhaps 25%. It is important that the width of the bristle retaining portion corresponds to the height of the bare lying tooth crowns of both tooth rows, contacting one another so that the edges of the gums cannot be injured by the stiff bristles. In other words: The width of the bristle retaining portion amounts to the spacing at most between the upper and the lower edges of the gums of both tooth rows when the latter are in contact with one another.

The free ends of the bristles 16 and the massaging pins 22 face a geometric surface 24, 26 which is concavely shaped in longitudinal direction (24) and in lateral direction (26).

In FIG. 3 the massaging elements 22 are formed as conical pins having a pointed end. Alternative forms are shown in FIGS. 4 to 6. According to FIG. 4 pins **22*a* have rounded ends. Pins 22*b* according to FIG. 5 have branched ends 28 and the pins 22*c* according to FIG. 6 have spherical ends 30**.

What I claim is:

1. In a toothbrush comprising a handle portion and a head portion at one end thereof, the head portion having a plurality of longitudinally aligned rows of bristles, a plurality of longitudinal rows of massaging elements longitudinally straddling the rows of bristles, the improvement comprising the width of the plurality of rows of bristles approximating twice the height of a tooth whereby the toothbrush is limited to movement in a longitudinal direction only during the cleaning process.

2. The toothbrush of claim 1 wherein each of the straddling rows has a width of 20 to 40 percent of the width of the plurality of bristle rows.

3. The toothbrush of claims 1 or 2 wherein the head portion is longitudinally curved and the bristles and massaging elements are located on the concave side of the curved head.

4. The toothbrush of claims 1 or 2 wherein the head portion is curved in both a longitudinal and transverse direction and the bristles and massaging elements are located on the concave side of the curved head.

5. An improved tooth brush and gum massaging device comprising a handle, a bristle head connected with said handle, a bristle retaining portion on the bristle head, a plurality of relatively stiff bristles attached to said bristle retaining portion, a pair of lateral portions on said bristle head, a plurality of massaging elements formed of rubber or suitable rubber substitute attached to each one of said pair of lateral portions, the bristle retaining portion being arranged between said pair of lateral portions, the improvement comprising a bristle head having an enlarged width sufficient for a simultaneous treatment of both tooth rows wherein: the width of the bristle retaining portion is substantially twice as great as the tooth height and the overall width and the overall length of the bristle head form a ratio of at least 2:3 and the width of the bristle retaining portion is 2.5 to 5 times greater than that of each lateral portion.

* * * * *